US008262357B2

(12) United States Patent
Mhetras

(10) Patent No.: US 8,262,357 B2
(45) Date of Patent: Sep. 11, 2012

(54) EXTENDED LENGTH HOLES FOR TIP FILM AND TIP FLOOR COOLING

(75) Inventor: Shantanu P. Mhetras, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 516 days.

(21) Appl. No.: 12/466,963

(22) Filed: May 15, 2009

(65) Prior Publication Data

US 2010/0290921 A1 Nov. 18, 2010

(51) Int. Cl.
*F01D 5/18* (2006.01)
*F03B 11/00* (2006.01)

(52) U.S. Cl. ..... 416/97 R; 416/96 R; 416/96 A; 416/92; 415/115; 415/116; 415/173.4; 415/173.5; 415/173.6

(58) Field of Classification Search ..... 415/115, 415/116, 173.4, 173.5, 173.6; 416/96 R, 416/96 A, 97 R, 92
See application file for complete search history.

(56) References Cited

U.S. PATENT DOCUMENTS

| | | | | |
|---|---|---|---|---|
| 4,462,754 | A | 7/1984 | Schofield | |
| 4,487,550 | A | 12/1984 | Horvath et al. | |
| 5,183,385 | A | 2/1993 | Lee et al. | |
| 5,660,523 | A | 8/1997 | Lee | |
| 6,461,107 | B1 | 10/2002 | Lee et al. | |
| 6,916,150 | B2 | 7/2005 | Liang | |
| 6,932,571 | B2 * | 8/2005 | Cunha et al. | 416/97 R |
| 7,192,250 | B2 | 3/2007 | Boury et al. | |
| 7,537,431 | B1 * | 5/2009 | Liang | 416/95 |
| 2009/0068021 | A1 * | 3/2009 | Liang | 416/97 R |

OTHER PUBLICATIONS

Han, Je-Chin.; Recent Studies in Turbine Blade Cooling; International Journal of Rotating Machinery, 10(6); 2004; pp. 443-457; Taylor & Francis Inc.

* cited by examiner

*Primary Examiner* — Michelle Mandala

(57) ABSTRACT

The tip cooling arrangement of the present application reduces large cooling flow requirements which can compromise turbine performance. The tip cooling arrangement of the present application provides convective cooling of a turbine blade tip end, whether a flat tip or a squealer, by extending holes that provide fluid for film cooling the tip end. The holes are thus lengthened and extend from the relatively cooler suction side of the blade to the pressure side of the blade in close proximity to the floor of the tip end.

20 Claims, 6 Drawing Sheets

EXTENDED LENGTH HOLES FOR TIP FILM AND TIP FLOOR COOLING

FIELD OF THE INVENTION

This invention is directed generally to turbine blades and, more particularly, to an arrangement for cooling the tip end of a turbine blade by conducting cooling fluid from an inner cavity through elongated holes that extend from proximate a suction side of the blade to cooling orifices in the pressure side of the blade. The holes are positioned so that cooling fluid passing from the cavity through the elongated holes cools the tip end during its passage and is discharged from the cooling orifices to mix with and cool hot gas before it passes over the tip end, which can be a flat tip or a squealer.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

The blade tip region is an area of particularly high thermal stress which is exposed to high heat load due to high external heat transfer coefficients in this region and ineffective convective cooling due to its geometry. Migration of mid-span hot gas to the blade tip region also contributes to the problem. Typical blade designs, illustrated in FIG. 1 by a sectional view of a blade 100 having a pressure side 102 and a suction side 104, rely on extensive film cooling to reduce the gas temperature in contact with the blade tip end 106. Common film cooling arrangements use one row of holes 108 on the pressure side 102 of the blade 100 just below the tip end 106, illustrated in FIG. 1 as a squealer having a rail 110 defining a squealer cavity 112, and several rows of holes 114 through the floor 116 of the squealer cavity 112 of the tip end 106. The large number of film holes 108, 110 requires a large amount of cooling air flow which may compromise the performance of the gas turbine.

SUMMARY OF THE INVENTION

In accordance with one aspect of the invention, a turbine blade comprises a generally elongated blade having a leading edge, a trailing edge, a pressure side and a suction side. A tip is located at a first end of the elongated blade and a root is coupled to the elongated blade at a second end generally opposite the first end. The root supports the elongated blade and couples the elongated blade to a disc. A cooling system includes at least one inner cavity in the elongated blade and further comprises at least one elongated cooling hole having a first end in communication with the inner cavity proximate the suction side of the elongated blade and a second end defining a cooling orifice in the pressure side of the elongated blade. The elongated cooling hole is positioned so that cooling fluid passing from the cavity through the elongated cooling hole cools the tip and is discharged from the orifice on the pressure side of the elongated blade to mix with and cool hot gas before it passes over the tip.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
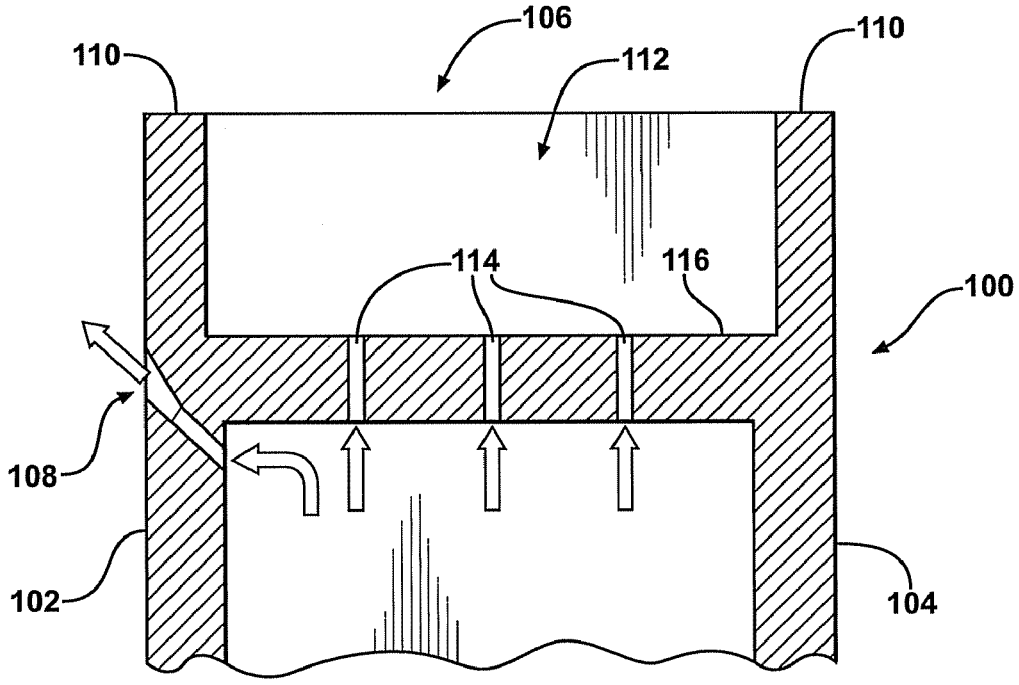
FIG. 1 PRIOR ART
FIG. 1 is a schematic sectional view of a prior art turbine blade showing a typical film cooling arrangement for a tip end of the turbine blade.
Figure 3:
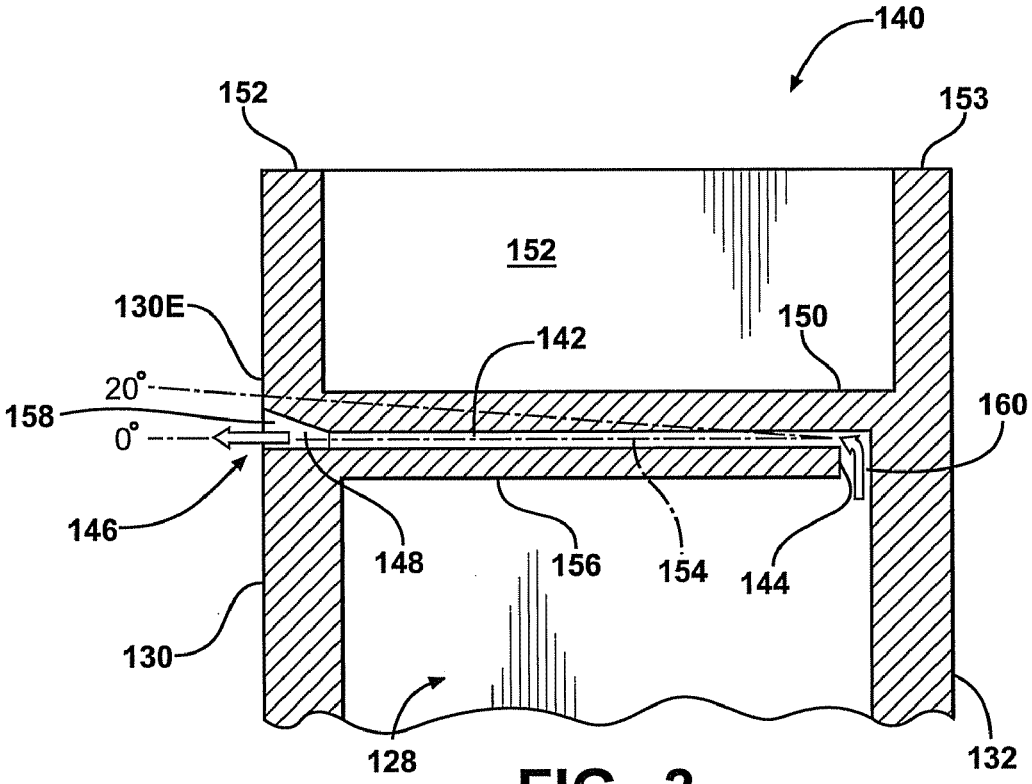
FIG. 3 is a schematic sectional view taken along section line 3 of FIG. 2 through an elongated hole of the tip cooling arrangement of the present application.
Figure 2:
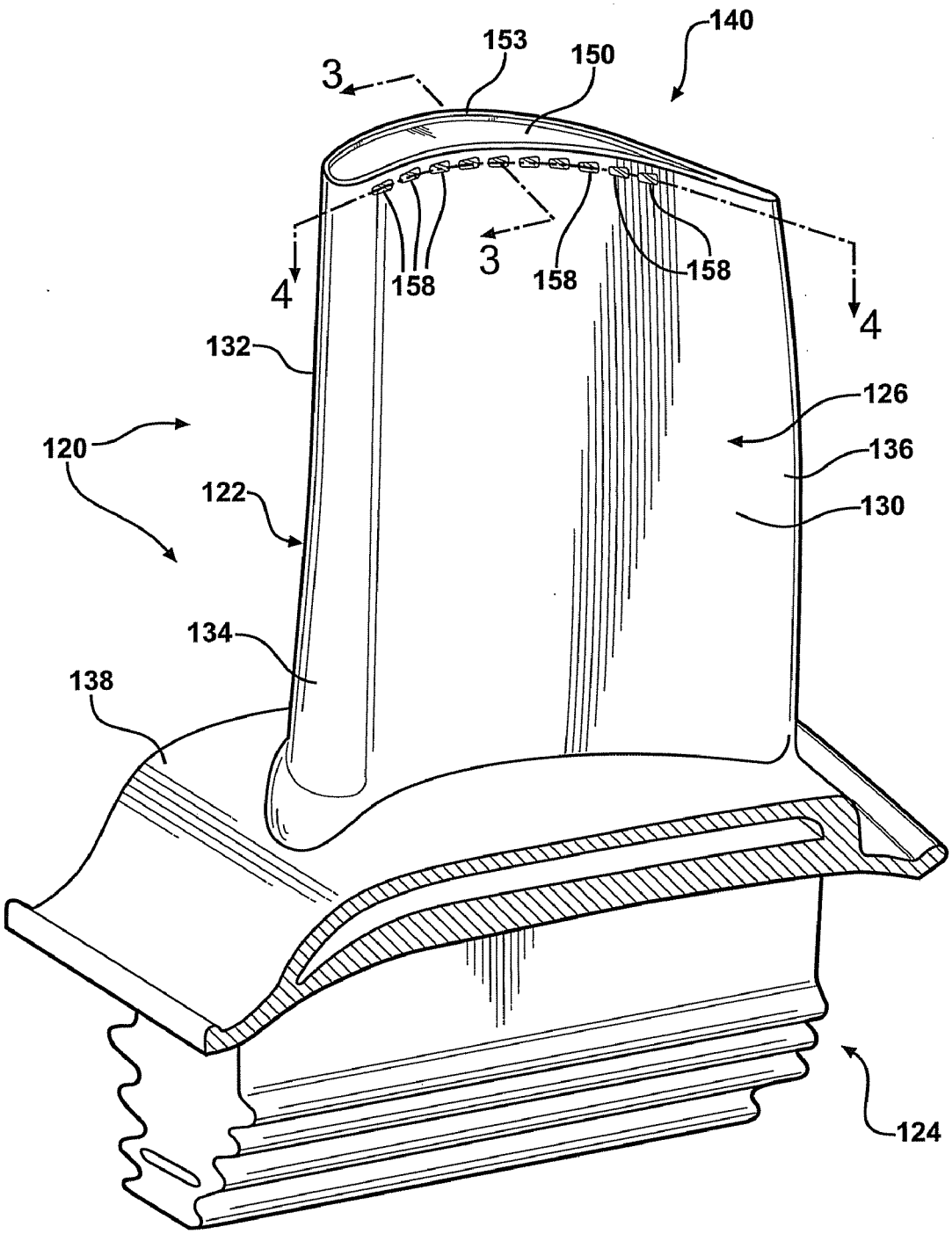
FIG. 2 is a perspective view of a turbine blade including an elongated blade incorporating an embodiment of the tip cooling arrangement of the present application.

Referring to FIG. 2, an exemplary turbine blade 120 for a gas turbine engine is illustrated. The blade 120 includes an elongated blade 122 and a root 124 which is used to conventionally secure the blade 120 to a rotor disk of the engine for supporting the blade 120 in the working medium flow path of the turbine where working medium gases exert motive forces on the surfaces of the elongated blade 122. The elongated blade 122 has an outer wall 126 that surrounds at least one inner cavity 128 (FIG. 3). The outer wall 126 comprises a generally concave pressure side 130 and a generally convex suction side 132 which are spaced apart in a widthwise direction to define the inner cavity 128 therebetween. The pressure and suction sides 130, 132 extend between and are joined together at an upstream leading edge 134 and a downstream trailing edge 136. The leading and trailing edges 134, 136 are spaced axially or chordally from each other. The elongated blade 122 extends radially along a longitudinal or radial direction of the blade 120, defined by a span of the elongated blade 122, from a radially inner platform 138 to a radially outer blade tip 140.

Figure 4:
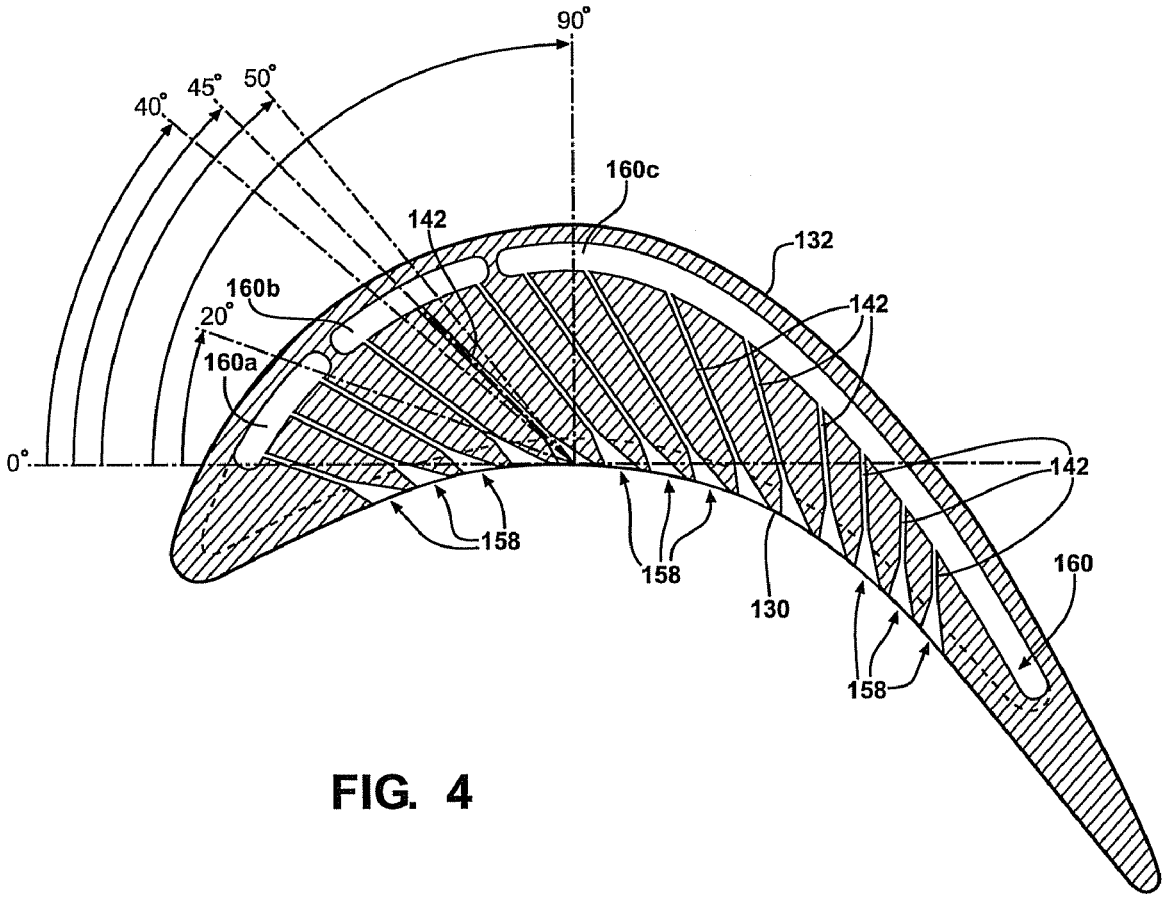
FIG. 4 is a sectional view taken along section line 4 of FIG. 2 through elongated holes of the tip cooling arrangement of the present application.
Figure 5:
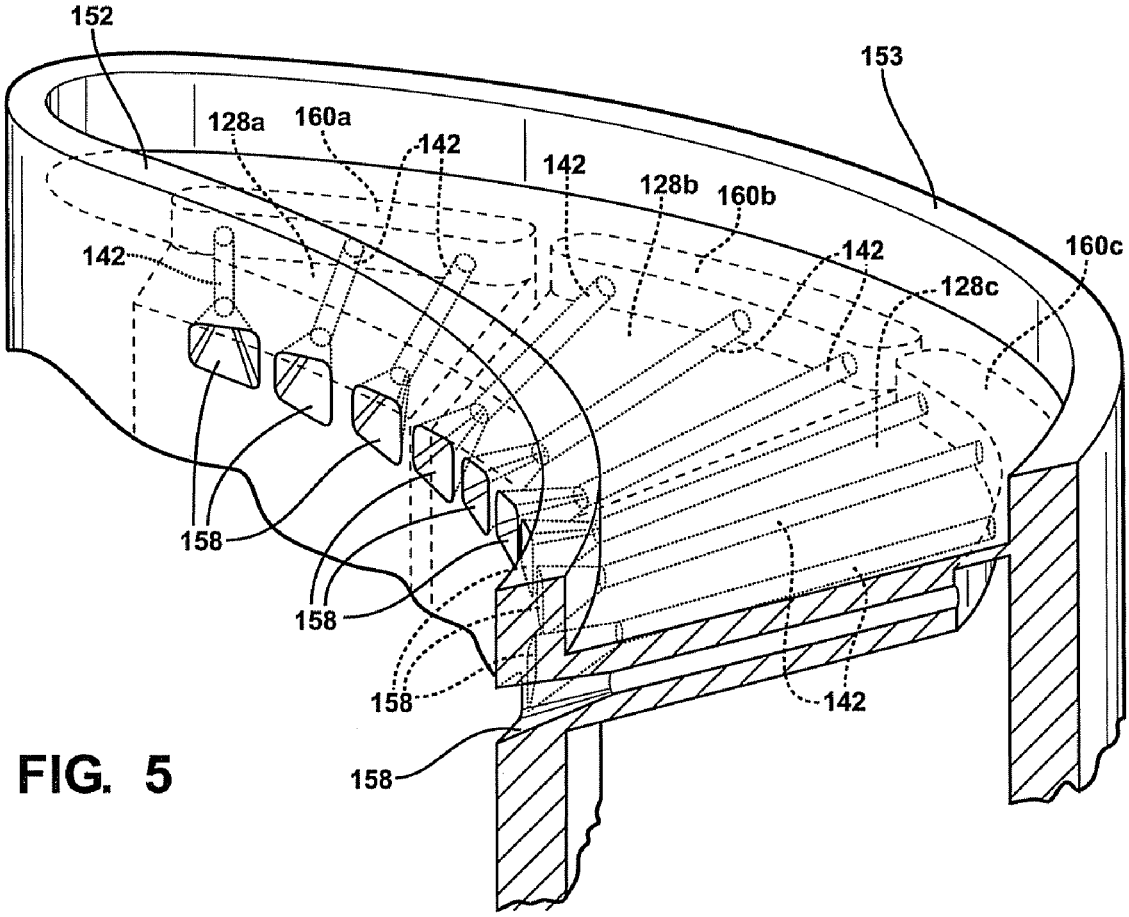
FIG. 5 is a partial perspective view of the tip end of the elongated blade illustrating the elongated holes in association with cooling cavity passages in the elongated blade.

Referring additionally to FIGS. 3-5, a cooling system for the blade 120 comprises the inner cavity 128 in the elongated blade 122 and at least one elongated cooling hole 142 having a first end 144 in communication with the inner cavity 128 proximate the suction side 132 of the elongated blade 122 and a second end 146 defining a cooling orifice 148 in the pressure side 130 of the elongated blade 122, the elongated cooling hole 142 being positioned so that cooling fluid passing from the cavity 128 through the elongated cooling hole 142 convectively cools the tip 140 and is discharged from the orifice 148 on the pressure side 130 of the elongated blade 122 to mix with and cool hot gas before it passes over the tip 140. The at least one elongated cooling hole 142 can be formed in the tip 140, for example in the floor 150 of a squealer cavity 152 of the tip 140 of the elongated blade 122. The cooling arrangement of the present application can also be used for turbine blades having flat tips.

The at least one elongated cooling hole 142 defines a substantially linear axis 154 between the first and second ends 144, 146 of the at least one elongated cooling hole 142. The axis 154 is oriented at a first angle, within a range of about 0 degrees to about 20 degrees (FIG. 3), relative to inner and outer surfaces of the tip 140, for example the floor 150 of the squealer cavity 152 and the inner surface 156 of the inner cavity 128, and is oriented at a second angle, for example from about 20 degrees to about 90 degrees relative to the exit surface 130E of the pressure side 130 of the elongated blade 122 (FIG. 4). The second angle is currently contemplated as being within a range of 40 degrees to 50 degrees, and, for example, at an angle of 45 degrees. The cooling orifice 148 may comprise a conventional diffuser film hole 158 wherein the diffuser film hole is fanshaped, laidback or is both fanshaped and laidback as illustrated.

To adequately cool the tip of the turbine blade 120, the at least one elongated hole 142 in the elongated blade 122 comprises a plurality of elongated cooling holes 142. The floor of the tip 140, i.e., the floor 150 of the squealer cavity 152 as illustrated in FIG. 3, further comprises at least one slot 160 extending radially into the inner surface 156 of the floor 150, and extending longitudinally in a cordal direction. The at least one slot 160 is proximate the suction side 132 of the tip 140 and at least one of the plurality of holes 142 is in fluid communication with the inner cavity 128 via the at least one slot 160. A plurality of slots 160, for example the slots 160*a* through 160*c* as illustrated in FIG. 4, can also be used. In particular, the plurality of slots 160*a*, 160*b* and 160*c* may each be associated with a respective cavity passage 128*a*, 128*b* and 128*c* of the inner cavity 128, as may be seen in FIG. 5.

Figure 6:
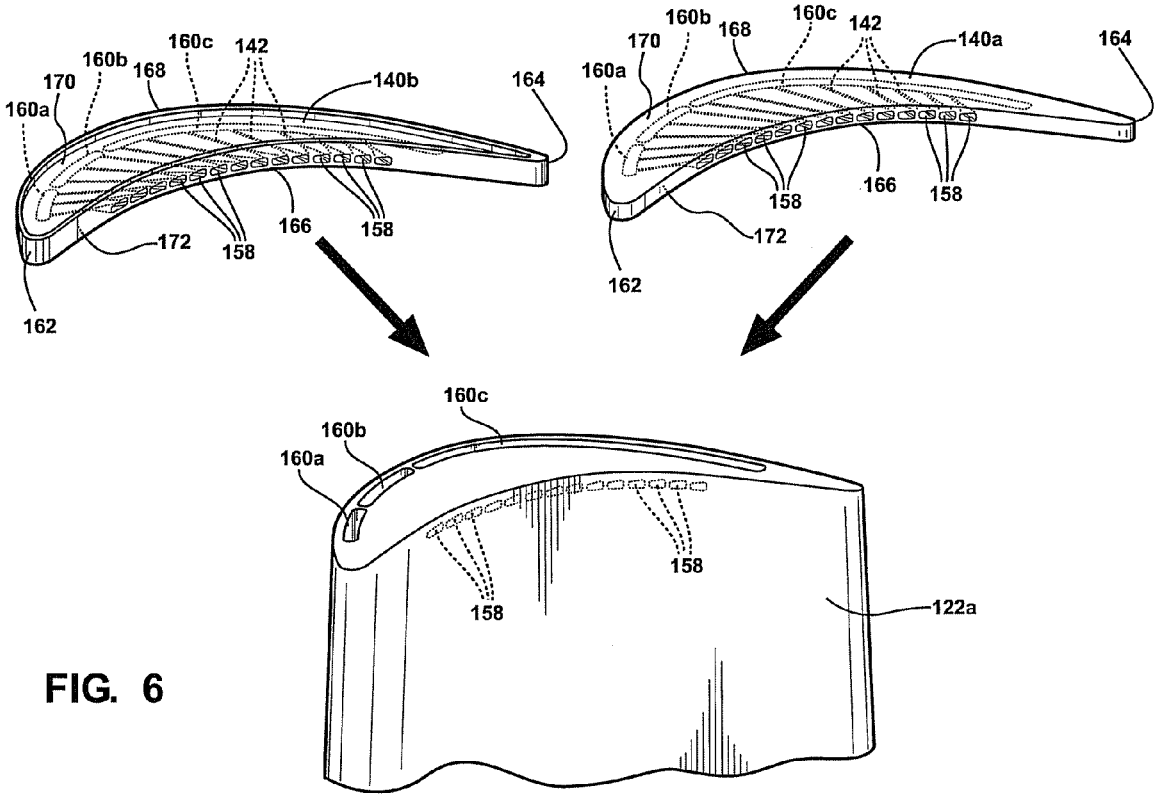
FIG. 6 is an exploded view of an elongated blade showing an elongated blade, a flat blade tip and a squealer tip.
Figure 7:
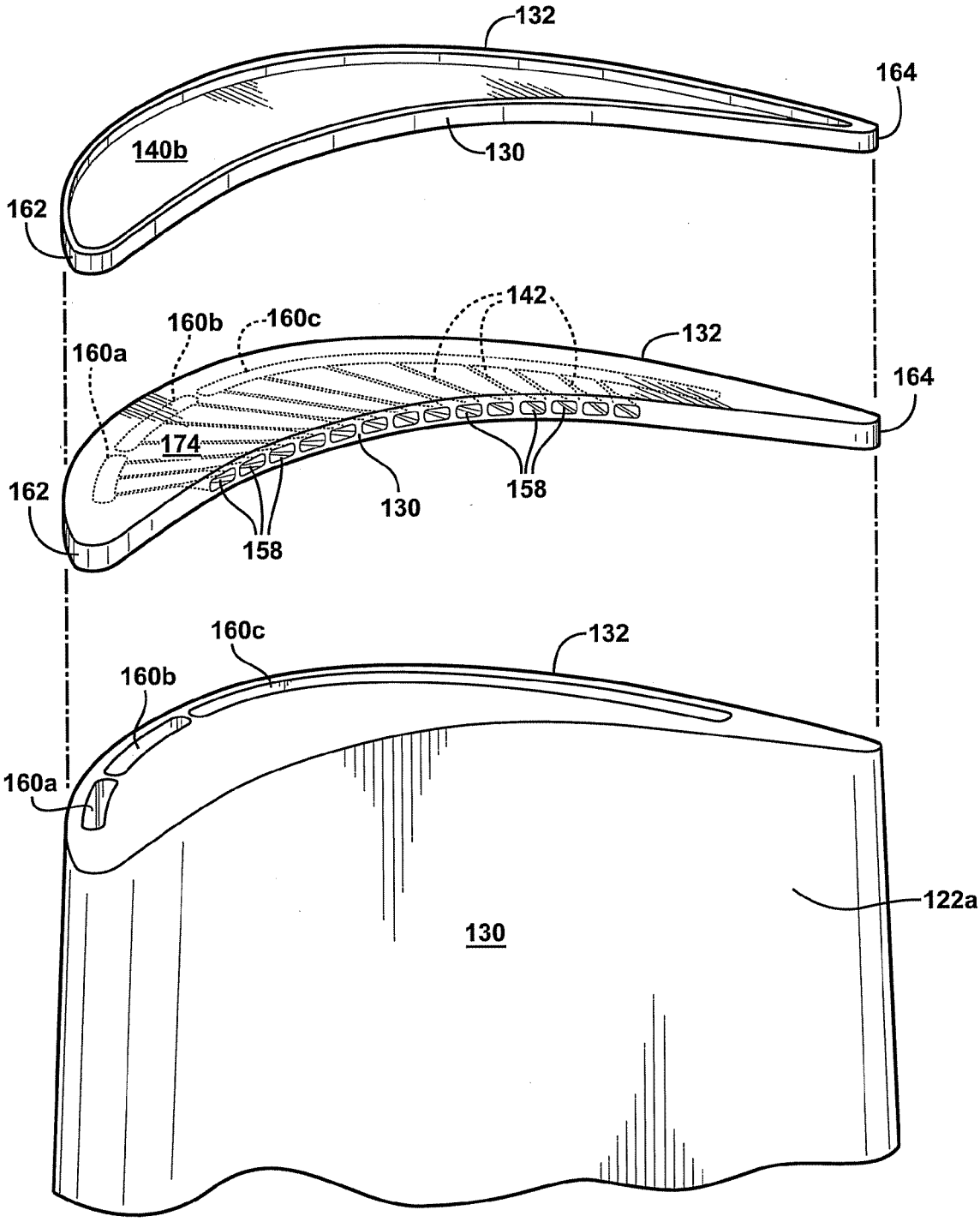
FIG. 7 is an exploded view showing a cooling plate which can be used for the tip cooling arrangement of the present application.

FIG. 6 is an exploded view of an elongated blade 122*a* showing two alternative embodiments for constructing the turbine blade 120 including a flat blade tip 140*a* and a squealer tip 140*b*. The tips 140*a*, 140*b* include a leading edge 162, a trailing edge 164, a pressure side 166, a suction side 168, an outer surface 170 and an inner surface 172. The plurality of elongated cooling holes 142 can be formed in the tip 140*a*, 140*b* or in the elongated blade 122*a* itself. Alternately, as shown in FIG. 7, the floor 150 may comprise a cooling plate 174 with the plurality of elongated cooling holes 142 being formed in the cooling plate 174 and the cooling plate 174 being positioned between and secured to the first end of the elongated blade 122*a* and the tip 140, illustrated as a squealer end 140*b*, to form the elongated blade 122.

As noted above, the elongated blade 122 comprises a pressure side 130 and a suction side 132. The pressure and suction sides 130, 132 define an outer wall of the elongated blade 122, and the outer wall defines the inner cavity 128 as a cooling fluid passage within the elongated blade 122. The cooling fluid passage extends from a location proximate the second end to the first end of the elongated blade 122 to convey cooling fluid in a spanwise direction through the elongated blade 122 to the first end of the at least one elongated cooling hole 142. The cooling fluid passage may extend through a plurality of passages such as the cavity passages 128*a*, 128*b* and 128*c* illustrated in FIG. 5.

As illustrated, the tip 140 comprises a partition member, i.e., the floor 150, between the inner cavity 128 and the squealer cavity 152 defined by a squealer rail 153 extending radially from the outer wall, and the at least one cooling hole 142 extends through the partition member from the first end 144, positioned at a junction between the inner cavity 128 and the suction side 132, to the second end 146 at the pressure side 130. The at least one elongated cooling hole 142 comprises a plurality of elongated cooling holes 142 defining a plurality of cooling orifices 148 in the pressure side 130 of the elongated blade 122. The plurality of cooling orifices 148 comprises a plurality of diffuser film holes.

From the foregoing description, it should be apparent that the tip cooling arrangement of the present application reduces large cooling flow requirements which otherwise can compromise the performance of a gas turbine. The cooling flow reduction contrasts with the large amount of cooling air flow for extensive film cooling required for tip cooling in typical prior art blade designs having a large number of film holes. The tip cooling arrangement of the present application provides convective cooling of a turbine blade tip end, whether a flat tip or a squealer, by extending the holes that provide fluid for film cooling the tip end. The holes are thus lengthened to extend from the relatively cool suction side of the blade to the pressure side of the blade in close proximity to the floor of the tip end.

The row of pressure side film cooling holes 142 is drilled into the tip at an angle of from 0 degrees to 20 degrees and is fed cooling fluid through one or more slots near the suction side of an inner cooling cavity. The film cooling holes 142 are also angled at from about 20 degrees to about 90 degrees relative to the exit surface 130E of the pressure side 130 of the elongated blade 122. The angling of the cooling holes 142 relative to the exit surface 130E produces long cooling holes 142 through which cooling fluid passes prior to film ejection. The plurality of long cooling holes 142 extracts a significant amount of heat from the tip surface before ejection into the free-stream on the pressure side of the blade. By convectively cooling the floor 150 of the tip end 140, film holes through the tip end are not required thus reducing the cooling mass flow requirement.

The long cooling holes 142 can use diffuser exits to improve film coverage on the pressure side of the blade. While film coverage on the pressure side of the blade may be lower than the typical film cooling arrangement, the reduction in coverage should be small and can be further reduced by selection of the film hole diffuser shapes. The addition of convective cooling through the long holes will significantly improve the blade tip cooling capability and improve life of the tip region.

Additionally, the tip cooling arrangement of the present application is more practical from a manufacturing standpoint as well as from a service repair standpoint. The arrangement can be produced using current manufacturing processes for casting and hole drilling. Also, during service repair for damaged blade tips, the disclosed arrangement will make it easier to rebuild the tip through welding in case of tip parent metal loss.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade, comprising:

a generally elongated blade having a leading edge, a trailing edge, a pressure side and a suction side;

a tip at a first end of said elongated blade;

a root coupled to said elongated blade at a second end generally opposite said first end for supporting said elongated blade and for coupling said elongated blade to a disc;

a cooling system including at least one inner cavity in said elongated blade; and wherein the cooling system further comprises:

at least one elongated slot extending radially outwardly from said inner cavity, and having a direction of elongation in a chordal direction of said elongated blade;

a plurality of elongated cooling holes having a first end in communication with said at least one slot and with said inner cavity proximate said suction side of said elongated blade and a second end defining a cooling orifice in said pressure side of said elongated blade, each of said elongated cooling holes defining a substantially linear axis between said first and second ends of each of said elongated cooling holes; and said elongated cooling holes being positioned so that cooling fluid passing from said cavity through said elongated cooling holes cools said tip and is discharged from said orifice on said pressure side of said elongated blade to mix with and cool hot gas before it passes over said tip.

2. A turbine blade as claimed in claim 1, wherein said elongated cooling holes are formed in said tip.

3. A turbine blade as claimed in claim 1, wherein said axes of said cooling holes are oriented at a first angle relative to inner and outer surfaces of said tip and are oriented at a second angle relative to an exit surface of said pressure side of said elongated blade.

4. A turbine blade as claimed in claim 3, wherein said first angle is within a range of from about 0 degrees to about 20 degrees.

5. A turbine blade as claimed in claim 4, wherein said second angle is within a range of about 20 degrees to about 90 degrees.

6. A turbine blade as claimed in claim 5 wherein said second angle is within a range of about 40 degrees to 50 degrees.

7. A turbine blade as claimed in claim 5 wherein said second angle is about 45 degrees.

8. A turbine blade as claimed in claim 3, wherein said orifice comprises a diffuser film hole.

9. A turbine blade as claimed in claim 1, wherein said tip includes a leading edge, a trailing edge, a pressure side, a suction side, an outer surface and an inner surface, and said at least one slot extends into said inner surface of said tip, said at least one slot being proximate said suction side of said tip and each of said plurality of holes being in fluid communication with said inner cavity via said at least one slot.

10. A turbine blade as claimed in claim 9, wherein said plurality of elongated cooling holes is formed in said tip.

11. A turbine blade as claimed in claim 9, wherein said plurality of elongated cooling holes is formed in said elongated blade.

12. A turbine blade as claimed in claim 9, further comprising a cooling plate wherein said plurality of elongated cooling holes are formed in said cooling plate, said cooling plate being positioned between said first end of said elongated blade and said tip.

13. A turbine blade as claimed in claim 1, wherein said pressure and suction sides define an outer wall of said elongated blade, and said outer wall defining said inner cavity as a cooling fluid passage within said elongated blade.

14. A turbine blade as claimed in claim 13, wherein said cooling fluid passage extends from a location proximate said second end to said first end of said elongated blade to convey cooling fluid in a spanwise direction through said elongated blade to first ends of said elongated cooling holes.

15. A turbine blade as claimed in claim 14, wherein said tip comprises a partition member between said inner cavity and a squealer cavity defined by a squealer rail extending radially from said outer wall, and said elongated cooling holes extend through said partition member from said first end, positioned at a junction between said inner cavity and said suction side, to said second end at said pressure side.

16. A turbine blade as claimed in claim 1, wherein said plurality of cooling orifices comprises a plurality of diffuser film holes.

17. A turbine blade as claimed in claim 1, wherein said at least one elongated slot comprises a plurality of elongated slots spaced apart in the chordal direction of said elongated blade, each slot supplying cooling fluid from said inner cavity to a plurality of said elongated cooling holes.

18. A turbine blade, comprising:

a generally elongated blade having a leading edge, a trailing edge, a pressure side and a suction side;

a tip at a first end of said elongated blade;

a root coupled to said elongated blade at a second end generally opposite said first end for supporting said elongated blade and for coupling said elongated blade to a disc; and a cooling system comprising:

at least one inner cavity in said elongated blade;

at least one elongated slot extending radially outwardly from said inner cavity and having a direction of elongation in a chordal direction of said elongated blade; and a plurality of elongated cooling holes spaced apart from one another in the chordal direction of said elongated blade, each elongated cooling hole having:

a first end in communication with said at least one slot and with said inner cavity proximate said suction side of said elongated blade; and a second end defining a cooling orifice in said pressure side of said elongated blade;

wherein each of said elongated cooling holes defines a substantially linear axis between said respective first and second ends; and wherein said elongated cooling holes are positioned so that cooling fluid passing from said cavity through said elongated cooling holes cools said tip and is discharged from said orifice on said pressure side of said elongated blade to mix with and cool hot gas before it passes over said tip.

19. A turbine blade as claimed in claim 18, wherein said tip includes a leading edge, a trailing edge, a pressure side, a suction side, an outer surface and an inner surface, and said at least one slot extends between said outer surface and said inner surface of said tip, said at least one slot being proximate said suction side of said tip and each of said plurality of holes being in fluid communication with said inner cavity via said at least one slot.

20. A turbine blade as claimed in claim 18, wherein said at least one elongated slot comprises a plurality of elongated slots spaced apart in the chordal direction of said elongated blade, each slot supplying cooling fluid from said inner cavity to a plurality of said elongated cooling holes.

* * * * *